US009017227B1

(12) United States Patent
Vargas

(10) Patent No.: US 9,017,227 B1
(45) Date of Patent: Apr. 28, 2015

(54) PORTABLE STRIKING PAD DEVICE

(76) Inventor: Oscar Vargas, Miami, FL (US)

( * ) Notice: Subject to any disclaimer, the term of this patent is extended or adjusted under 35 U.S.C. 154(b) by 141 days.

(21) Appl. No.: 13/277,429

(22) Filed: Oct. 20, 2011

(51) Int. Cl.

| | |
|---|---|
| ***A63B 69/34*** | (2006.01) |
| ***A63B 69/22*** | (2006.01) |
| ***A63B 69/24*** | (2006.01) |
| ***A63B 69/28*** | (2006.01) |
| ***A63B 69/30*** | (2006.01) |
| ***A63B 69/00*** | (2006.01) |
| ***A63B 69/20*** | (2006.01) |

(52) U.S. Cl.
CPC ..... *A63B 69/34* (2013.01); *A63B 69/004* (2013.01); *A63B 69/20* (2013.01); *A63B 2244/106* (2013.01); *A63B 2244/102* (2013.01); *A63B 2244/10* (2013.01)

(58) Field of Classification Search
CPC ..... A63B 69/004; A63B 2244/10; A63B 2244/102; A63B 2244/106
USPC ..... 482/23, 83–90; D21/798, 787; 297/216.13; 473/453
See application file for complete search history.

(56) References Cited

U.S. PATENT DOCUMENTS

| | | | | | |
|---|---|---|---|---|---|
| 944,648 | A | * | 12/1909 | Austin | 482/83 |
| 2,558,081 | A | * | 6/1951 | Gardenhour | 473/445 |
| 2,929,629 | A | * | 3/1960 | Feula | 473/445 |
| 2,934,343 | A | * | 4/1960 | Schumacher | 473/445 |
| 3,336,805 | A | * | 8/1967 | Austin | 73/379.04 |
| 3,927,879 | A | * | 12/1975 | Long et al. | 482/83 |
| 4,087,089 | A | * | 5/1978 | Forrest | 473/445 |
| 4,209,168 | A | * | 6/1980 | Partlow | 482/87 |
| 4,239,209 | A | * | 12/1980 | Curchod | 482/83 |
| 4,512,569 | A | * | 4/1985 | Aragona | 482/87 |
| 4,527,796 | A | * | 7/1985 | Critelli | 482/86 |
| 4,946,159 | A | * | 8/1990 | Jones | 482/83 |
| 5,356,330 | A | * | 10/1994 | Cohen | 446/491 |
| 5,472,395 | A | * | 12/1995 | Trocchio | 482/83 |
| 5,554,088 | A | * | 9/1996 | Zlojutro | 482/83 |
| 5,624,358 | A | * | 4/1997 | Hestilow | 482/90 |
| 5,800,319 | A | * | 9/1998 | Choate | 482/83 |
| 5,921,896 | A | * | 7/1999 | Boland | 482/83 |
| 5,941,801 | A | * | 8/1999 | D'Alto | 482/90 |
| 6,036,602 | A | * | 3/2000 | Abbott | 463/47.2 |
| 6,063,011 | A | * | 5/2000 | Pelchat | 482/83 |
| 6,080,089 | A | * | 6/2000 | Nicholson | 482/83 |
| 6,302,831 | B1 | * | 10/2001 | Henry | 482/83 |
| 7,959,528 | B1 | * | 6/2011 | Wilkes et al. | 473/453 |
| 2012/0214648 | A1 | * | 8/2012 | Schlicher | 482/87 |

FOREIGN PATENT DOCUMENTS

| | | | | | |
|---|---|---|---|---|---|
| GB | 2249033 | A | * | 4/1992 | A63B 69/00 |
| GB | 2422788 | A | * | 8/2006 | A63B 69/00 |

OTHER PUBLICATIONS
http://en.wikipedia.org/wiki/Makiwara.

* cited by examiner

*Primary Examiner* — Oren Ginsberg
*Assistant Examiner* — Joshua Lee
(74) *Attorney, Agent, or Firm* — Jesus Sanchelima; Christian Sanchelima

(57) ABSTRACT

A portable striking pad device that has an elongated flat base with a deformable protrusion rigidly mounted thereon. The base member is removably mounted to vertical structures, such as walls, poles, or trees, among others. The protrusion member has a distal rounded end cooperatively shaped to receive punches and kicks from a user who practices martial arts. There are several ways to mount the device to a vertical structure, including straps, screws, or pressure-sensitive fastening members, among others. The device is molded in a unitary piece requiring minimum maintenance.

4 Claims, 2 Drawing Sheets

PORTABLE STRIKING PAD DEVICE

BACKGROUND OF THE INVENTION

1. Field of the Invention

The present invention relates to a portable striking pad device and, more particularly, to such a device that is suitable to receive punches from a user's hands, elbows, feet, and knees.

2. Description of the Related Art

Several designs for striking devices have been designed in the past. Most of them are bulky and occupy a considerable amount of space. Most of the devices in the prior art are either stationary or difficult to move about. Additionally, to absorb the punches, they ordinarily need to be heavy, making their transportation difficult.

The closest related art known to Applicant includes the conventional punching bags and sacs found in gyms. The makiwara is a padded striking post that is used as a training tool in various styles of traditional karate. However, it is stationary and requires the permanent assignment of a location. See http://en.wikipedia.org/wiki/Makiwara (last visited on Jul. 20, 2011).

The present invention provides a solution to the immobility of these training tools, as well as their bulkiness, with a portable striking pad device that can be affixed to a vertical surface, such as walls, poles, trees, and the like. This versatility expands the use of the device and permits a user to install it practically anywhere.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a striking pad device that provides all the functions of a makiwara and, additionally, it permits a user to utilize his/her knees and/or legs.

It is another object of this invention to provide such a device that is portable and utilizes a minimum amount of space for its storage and transportation.

It is still another object of the present invention to provide such a device that is made out of durable materials.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
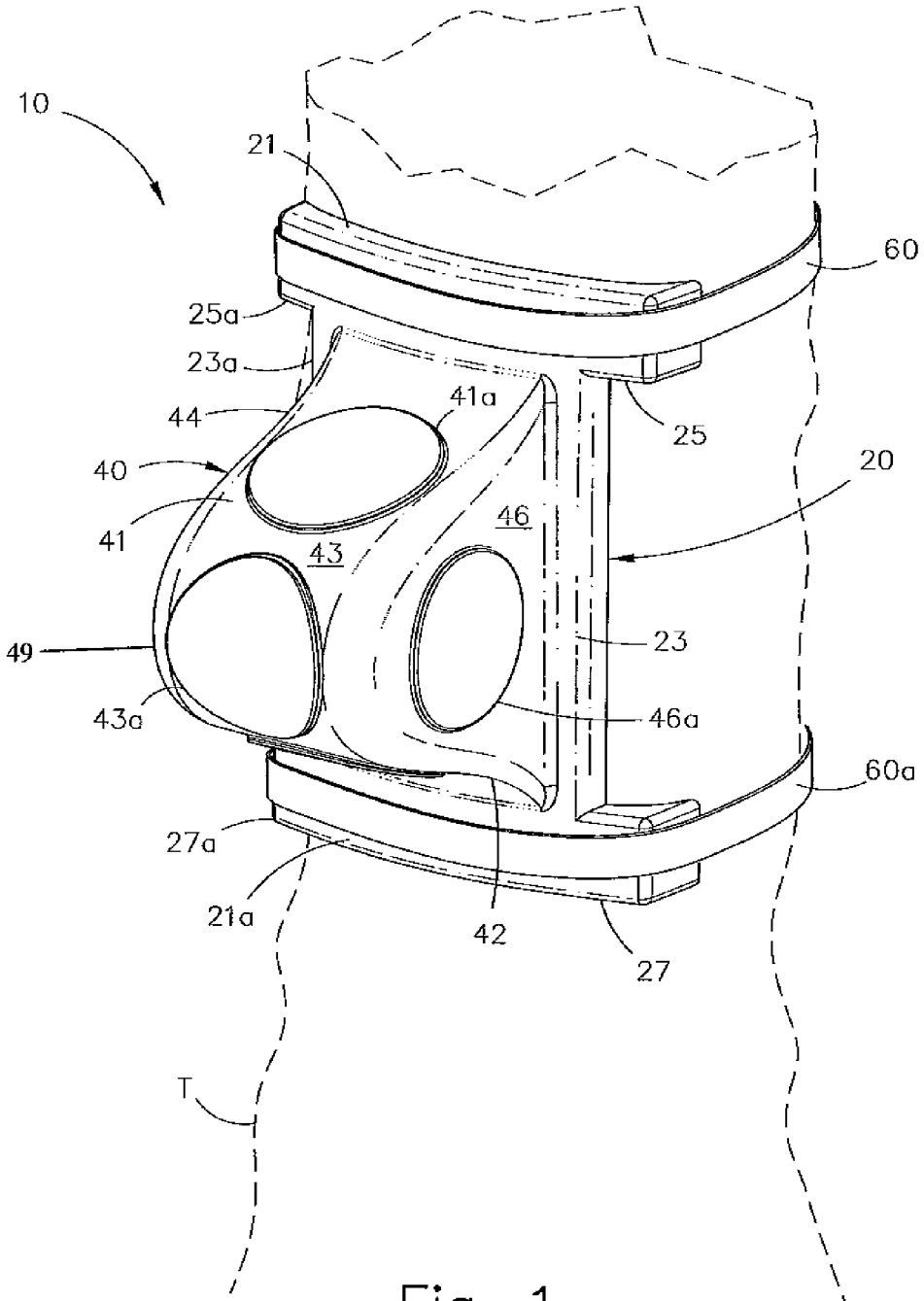
FIG. 1 represents an isometric view of a device incorporating the present invention, mounted to a tree.
Figure 2:
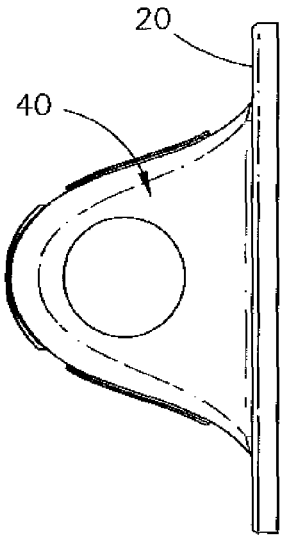
FIG. 2 shows an elevational view of the device represented in the previous figure.
Figure 3:
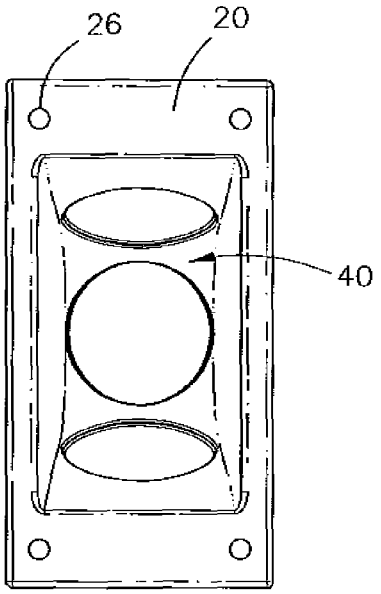
FIG. 3 illustrates a top view of the device shown in the previous figures.

Referring now to the drawings, where the present invention is generally referred to with numeral 10, it can be observed that it basically includes a base 20 and deformable protrusion or protuberance 40. Base 20 is substantially flat, extending longitudinally to define substantially a rectangle. Base 20 is made out of a resilient material permitting some deformation to substantially conform base 20 to the surface upon which it is mounted. Resilient materials, such as polyethylene or ethylene vinyl acetate, have been found suitable. Base 20 has upperside 22 and underside 24 with optional through holes 26, as best seen in FIG. 4.

In one of the embodiments, base member 20 includes ends 21 and 21*a*, each respectively including arms 25; 25*a* and 27; 27*a* that extend outwardly and perpendicularly with respect to lateral sides 23 and 23*a*, as seen in FIG. 1. Straps 60 and 60*a* are used to keep device 10 in place against a vertical structure having a substantially elongated shape of a predetermined diameter, such as a pole or a tree T. Different designs of straps 60; 60*a* can be used with substantially the same result of keeping device 10 at a predetermined height with respect to the floor. Arms 25; 25*a* and 27; 27*a* extend and embrace a portion of the pole or tree thereby facilitating the mounting of device 10 in one of the applications.

Figure 4:
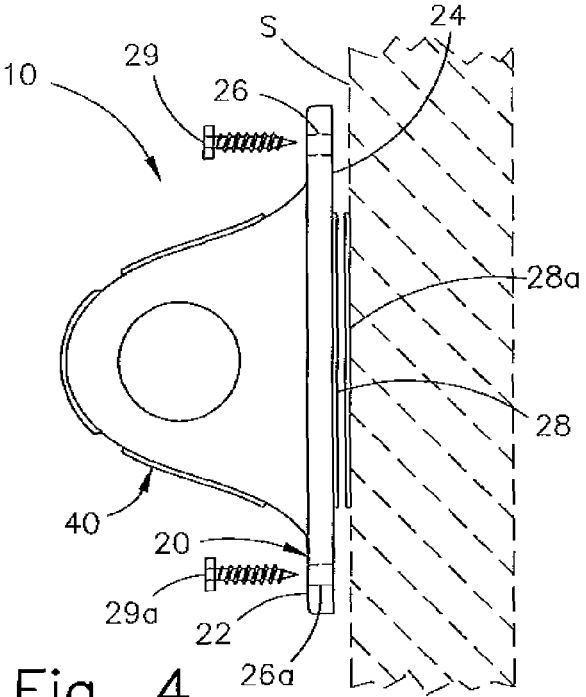
FIG. 4 shows an elevational view of the device mounted to a wall with Velcro pads. The wall is partially represented in cross-section.

In FIG. 4, device 10 is shown mounted to a vertical surface S using screws 29; 29*a* that are passed through through openings 26; 26*a*, respectively.

Figure 5:
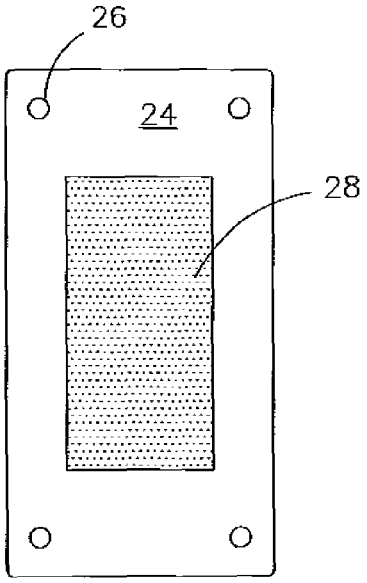
FIG. 5 is a representation of the back of the device shown in the previous figures with pressure-sensitive adhesive straps mounted on the back surface.

In another embodiment, pressure-sensitive adhesive pads 28, such as Velcro pads, can be mounted to underside 24 of base 20, as shown in FIG. 5. Cooperative mating pads 28*a* are mounted on a flat vertical surface, such as a wall. When pads 28 and 28*a* are pressed together, device 10 stays in place. The punches imparted to protuberance 40 that are perpendicular to the supporting vertical surface further secure the Velcro engagement. Blows that are substantially parallel to the wall are received by the curved portion of protuberance 40 with a perpendicular component that further enhances the engagement of device 10 to the wall. The parallel component is transmitted as a torque against the wall with minimal lifting action of base 20.

Deformable protrusion or protuberance member 40 extends perpendicularly outwardly from base, as shown in the drawings. Member 40 has a curved shape with lateral surfaces 41; 42 and end surface 43. Member 40 has a parabolic cross-section with outwardly extending edges 44. The sides 46 are substantially flat. Pads 41*a*; 43*a*; and 46*a* mark targets for a user and these can be replaced with graphical markings instead of pads. These pads are positioned on protuberance 40 between distal rounded end 49 and base member 20 at an angle with respect to the vertical surface of the vertical structure. In this manner, the blows from a user are partially diverted against the vertical structure.

Depending on the age and gender of the user, the material's density is selected. Lower density material is preferable for younger children and girls.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A striking pad device, comprising:

A) a base member having a substantially flat and elongated rectangular shape with first and second ends and first and second sides, said base member being made out of a resilient material that substantially conforms to the surface of a vertical structure, said base member having an upperside and an underside and wherein said vertical structure is an elongated pole member of predetermined dimensions and said base member includes first and second arm members extending from said first and second ends, respectively, and further including first and second strap members for partially embracing said pole member; and B) a deformable protrusion member having a parabolic cross-section and being mounted to said upperside and said protrusion member having an external surface and a distal rounded end and extending perpendicularly from said base member a predetermined distance to permit a user located adjacent to said surface and at a second predetermined distance from said device, to hit said rounded end with his or her hand, knee, foot, or elbow wherein said protrusion member includes at least two separate pad members on the external surface between said rounded end and said base member, said pad members being disposed as a continuation from said rounded end at an angle with respect to said surface so that the impact force of blows received from a user are diverted substantially perpendicularly against said structure.

2. The device set forth in claim 1 wherein said base member and said protrusion member are molded in a unitary piece.

3. The device set forth in claim 2 wherein said base member and said protrusion member are made out of polyethylene.

4. The claim set forth in claim 2 wherein said base member and said protrusion member are made out of ethylene vinyl acetate.

* * * * *